US009192956B2

(12) United States Patent
Kah, Jr. et al.

(10) Patent No.: US 9,192,956 B2
(45) Date of Patent: Nov. 24, 2015

(54) SPRINKLER FLOW STOP AND PRESSURE REGULATOR COMBINATION

(76) Inventors: Carl L. C. Kah, Jr., North Palm Beach, FL (US); Carl L. C. Kah, III, North Palm Beach, FL (US); Weiming Feng, West Palm Beach, FL (US); Richard Zhang, Riviera Beach, FL (US)

( * ) Notice: Subject to any disclaimer, the term of this patent is extended or adjusted under 35 U.S.C. 154(b) by 603 days.

(21) Appl. No.: 13/295,689

(22) Filed: Nov. 14, 2011

(65) Prior Publication Data

US 2012/0118405 A1 May 17, 2012

Related U.S. Application Data

(60) Provisional application No. 61/413,267, filed on Nov. 12, 2010.

(51) Int. Cl.

| | |
|---|---|
| ***B05B 15/10*** | (2006.01) |
| ***B05B 1/26*** | (2006.01) |
| ***B05B 15/00*** | (2006.01) |

(52) U.S. Cl.

CPC ..... *B05B 15/10* (2013.01); *B05B 1/262* (2013.01); *B05B 15/008* (2013.01); *Y10T 137/7793* (2015.04)

(58) Field of Classification Search

CPC ..... B05B 15/10; B05B 15/08; B05B 1/262; Y10T 137/7793

USPC ..... 239/203, 204, 571; 137/505, 71, 68.14

See application file for complete search history.

(56) References Cited

U.S. PATENT DOCUMENTS

| | | | | |
|---|---|---|---|---|
| 5,335,857 | A * | 8/1994 | Hagon | 239/204 |
| 5,762,270 | A * | 6/1998 | Kearby et al. | 239/205 |
| 6,000,632 | A * | 12/1999 | Wallace | 239/204 |
| 8,408,228 | B1 * | 4/2013 | Jimenez | 137/68.14 |
| 8,408,482 | B2 * | 4/2013 | Gregory | 239/206 |
| 2003/0218078 | A1 * | 11/2003 | Veazie | 239/203 |
| 2006/0278727 | A1 * | 12/2006 | Kah, Jr. | 239/67 |
| 2012/0043397 | A1 * | 2/2012 | Skripkar et al. | 239/204 |

* cited by examiner

*Primary Examiner* — Len Tran
*Assistant Examiner* — Joel Zhou
(74) *Attorney, Agent, or Firm* — Ostrolenk Faber LLP

(57) ABSTRACT

A sprinkler assembly including a pressure regulator and a flow stop element combined in a single assembly. In one embodiment, the sprinkler includes a sprinkler body in fluid communication with a water supply to provide water to the sprinkler, a riser movably mounted in the sprinkler body and in fluid communication with the sprinkler body such that the riser rises up and out of the sprinkler body when water is provided to the sprinkler, a nozzle assembly mounted on a top end of the riser and in fluid communication with the riser; and a regulation element mounted in the riser and in contact with a portion of the nozzle assembly. The nozzle assembly holds the regulation member in an open position to allow flow of water to the nozzle assembly and to maintain a substantially constant water pressure in the nozzle assembly.

11 Claims, 4 Drawing Sheets

SPRINKLER FLOW STOP AND PRESSURE REGULATOR COMBINATION

CROSS-REFERENCE TO RELATED APPLICATIONS

The present application claims benefit of and priority to U.S. Provisional Patent Application Ser. No. 61/413,267 filed Nov. 12, 2010, entitled BROKEN SPRINKLER FLOW STOP PRESSURE REGULATOR COMBINATION, the entire content of which is hereby incorporated by reference herein.

BACKGROUND

1. Field of the Disclosure

The present disclosure relates to a sprinkler assembly including a combined pressure regulator and flow stop element.

2. Related Art

A problem that may arise in sprinkler systems that include multiple stations linked together is a change in pressure in the system at different positions, due to changes in elevation, for example. Variations in pressure may also take place at the beginning of a supply line compared to the end of the supply line. In addition, for municipal supplies, water pressure is often at a maximum in the morning and decreases during the day. As a result, the inlet pressure to different sprinklers in the system may vary depending on position and other factors. These variations in inlet water pressure may result in improper flow at the outlet nozzle of the sprinkler. Thus, some sprinklers provide a pressure regulator to provide a more or less constant outlet pressure regardless of the inlet water pressure.

Another problem that may arise in irrigation systems, particularly in larger systems that cover a lot of ground, is water waste due to damaged sprinkler heads. In a larger system, damage to a sprinkler head may result in water waste that is unnoticed by the user who does not commonly inspect all sprinklers in the system on a regular basis.

Accordingly, it would be beneficial to provide a sprinkler that includes both pressure regulation and a shutoff function when damage has been incurred.

SUMMARY

It is an object of the present disclosure to provide an irrigation sprinkler that incorporates a pressure regulator and a broken sprinkler flow stop in combination.

In an embodiment, the irrigation sprinkler combines the components of a pressure regulator and a mechanically operated flow stop. The flow stop is preferably held open by the presence of the spray nozzle and riser tube of the sprinkler, in contrast to reference flow stops that are actuated from the increased flow and pressure drop across a flow stop valving member.

A sprinkler assembly in accordance with an embodiment of the present disclosure includes a sprinkler body in fluid communication with a water supply to provide water to the sprinkler, a riser movably mounted in the sprinkler body and in fluid communication with the sprinkler body such that the riser rises up and out of the sprinkler body when water is provided to the sprinkler, a nozzle assembly mounted on a top end of the riser and in fluid communication with the riser and a regulation element mounted in the riser and in contact with a portion of the nozzle assembly. The nozzle assembly holds the regulation member in an open position to allow flow of water to the nozzle assembly and to maintain a substantially constant water pressure in the nozzle assembly.

A sprinkler in accordance with an embodiment of the present disclosure includes a sprinkler body in fluid communication with a water supply to provide water to the sprinkler, a riser movably mounted in the sprinkler body and in fluid communication with the sprinkler body such that the riser rises up and out of the sprinkler body when water is provided to the sprinkler, a nozzle assembly mounted on a top end of the riser and in fluid communication with the riser and a regulation element mounted in the riser and in contact with a portion of the nozzle assembly, wherein the nozzle assembly holds the regulation member in an open position to allow flow of water to the nozzle assembly and wherein the flow of water to the nozzle assembly is shut off when the regulation element is not in contact with the portion of the nozzle assembly.

DETAILED DESCRIPTION OF THE EMBODIMENTS

Figure 1:
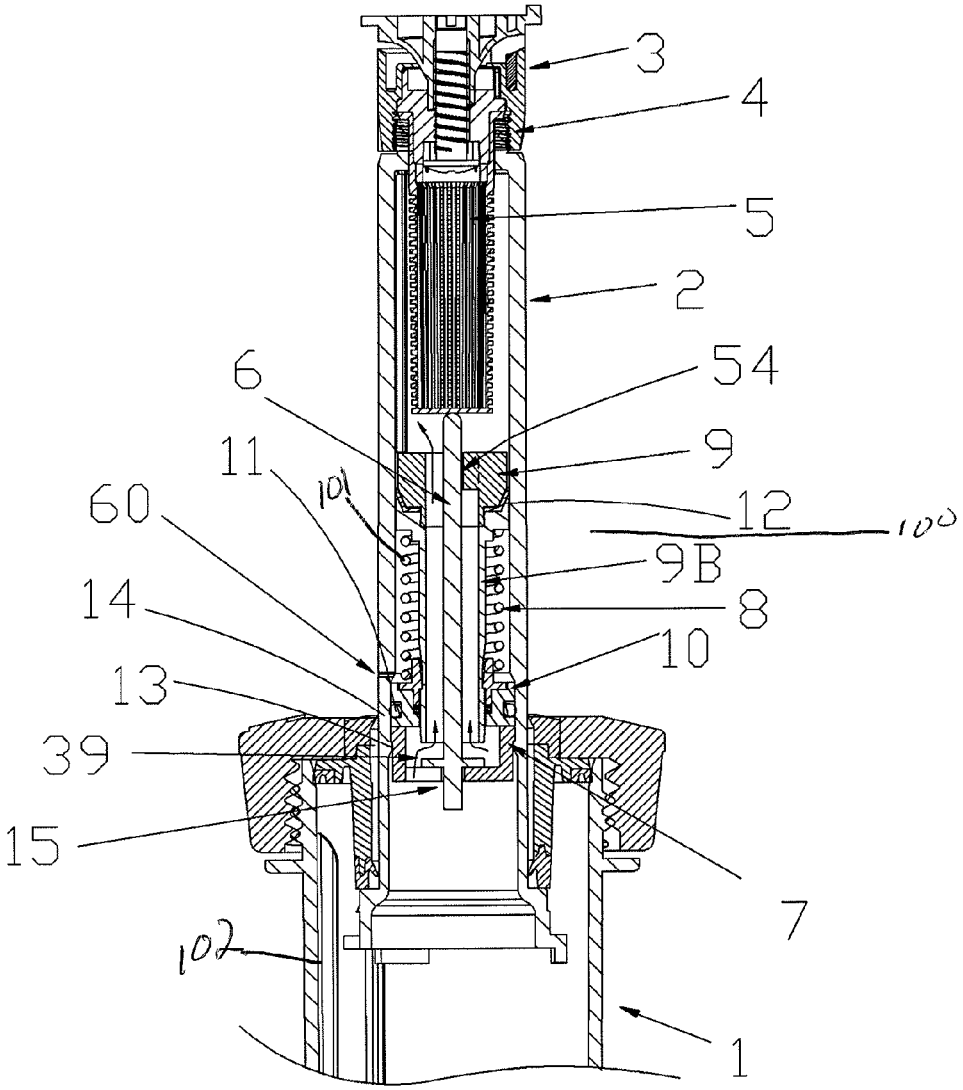
FIG. 1 is a cross sectional view of a pop-up irrigation sprinkler having a pressure regulator and flow stop element combined and mounted internally in its popped up riser in accordance with an embodiment of the present disclosure.

FIG. 1 illustrates a cross sectional view of a pop-up riser sprinkler 1 including a pressure regulator/broken sprinkler flow stop combination (regulation element) 100 mounted inside its pop-up riser 2 in accordance with an embodiment of the present disclosure. The riser 2 is mounted in a base 102 such that it pops up and retracts as a function of water pressure provided to the base 102 via a water supply (not shown). The supply of water may be provided via one or more supply pipes in an irrigation system that is preferably connected to a plurality of sprinklers. There is a spray nozzle assembly 3 mounted on top of the riser 2 with attachment threads at 4. The spray nozzle assembly 3 also includes a filter 5 with an upper flange is fitted into the retention thread, as at 4, of the spray nozzle assembly 3. A nozzle (not shown) is preferably provided in the spray nozzle assembly to direct water out of the sprinkler 1.

In a preferred embodiment, the regulation element 100 includes a pressure responsive member 9 with a low friction sliding seal 12 in contact with the inside wall of the sprinkler riser tube 2 and a center hollow connecting flow tube 9B whose circumferential upstream lower end functions as a pressure balanced upstream flow throttling valve in conjunction with member 39 to control water flow through the sprinkler riser 2 and to the nozzle assembly 3 mounted on its top end. The member 39 is a valve disc that is held down in its proper pressure regulating flow-throttling position by an axially centered rod 6. The rod 6 may be manufactured as a single piece with valve disc 39, if desired.

The rod 6 extends upward through the center of pressure responsive member 9, specifically through its hollow tube 9B and up into the area of the sprinkler riser tube 2 to a point just below where the spray nozzle assembly 3 and its filter basket 5 which protrudes down into the riser tube 2. The bottom of the filter basket 5 contacts the top end of rod 6 to maintain valve disc 39 in its proper position against the lower valve seat centering cup 7. So long as the spray nozzle assembly 3 and the upper portion of the sprinkler riser assembly 2 are intact, flow is allowed to move through the pressure regulating valve hollow tube 9B. That is, the disc 39 is spaced away from the bottom opening of the tube 9B to allow water to flow therethrough.

Figure 2:
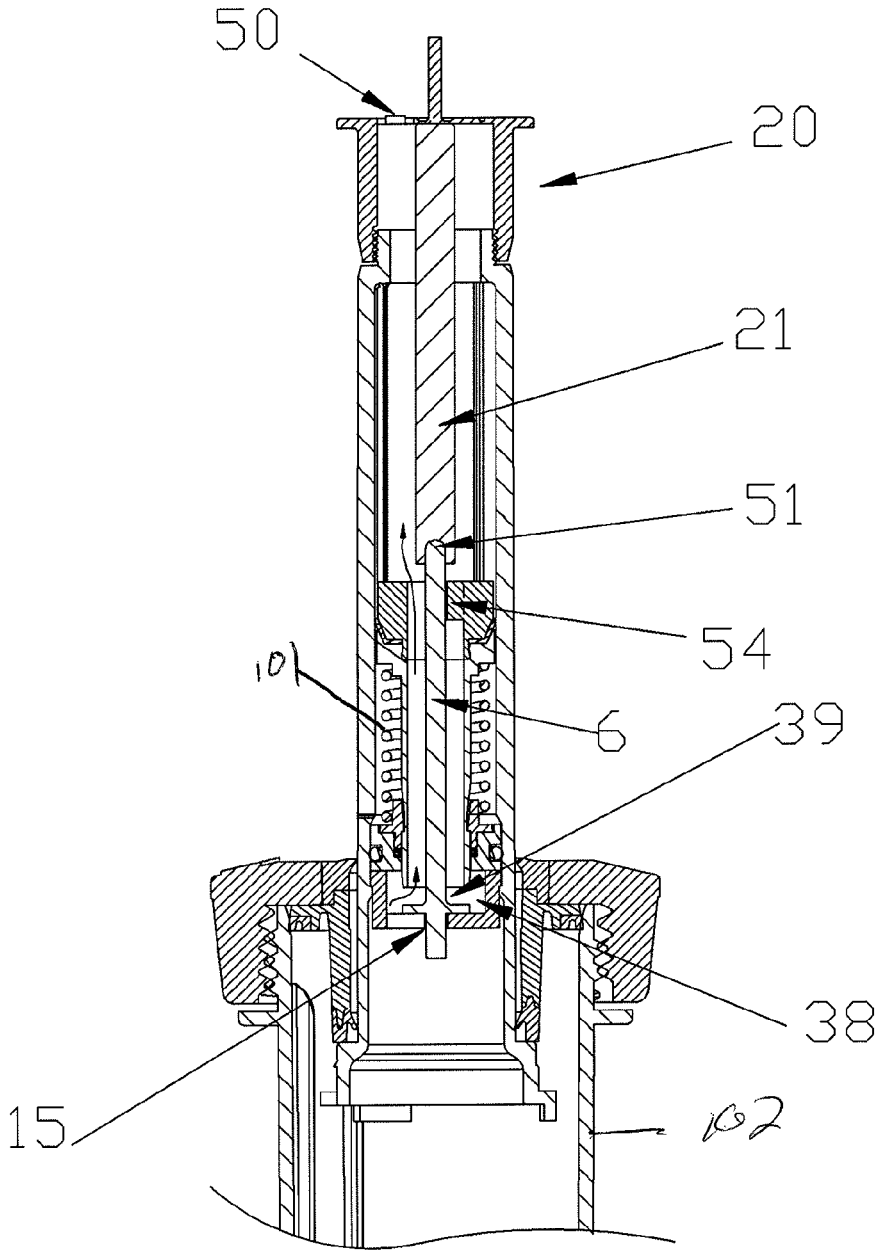
FIG. 2 is a cross sectional view, similar to FIG. 1, but with a flush closure member which has no filter basked replacing the spray nozzle assembly with a center shaft extension pressed on to the center push rod to replace the filter basket function of the spray nozzle assembly of FIG. 1.
Figure 3:
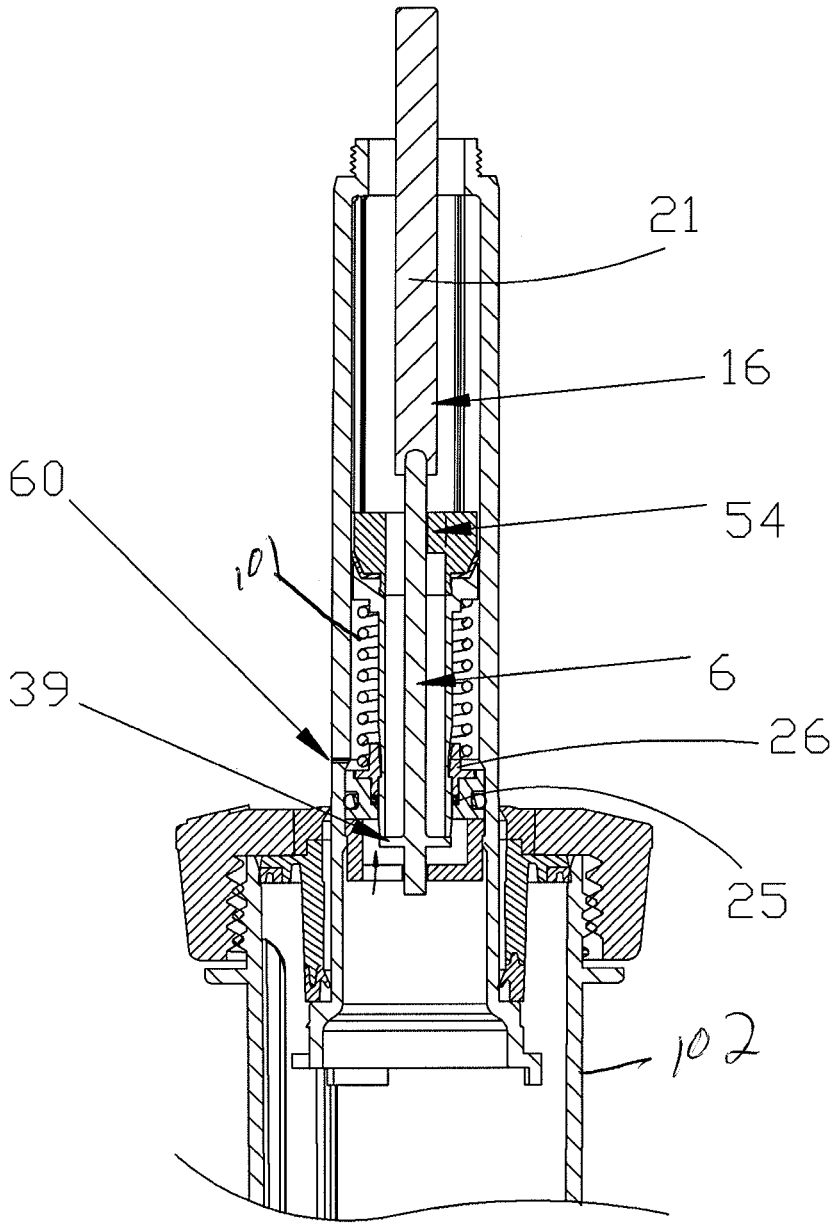
FIG. 3 is a cross sectional view of the pop-up riser irrigation sprinkler of FIG. 2, but with the flush cap removed and the flow stop valve in the closed position.

If the spray nozzle assembly 3 is removed, however, the lower disc 39 will move upwardly as shown in FIG. 3. Absent the presence of the filter basket 5 or flush cap 20 and rod extension 21 (See FIG. 2, for example) to hold the disc 39 in place against lower centering cap 7, the disc rises with the pressure of the water and against the lower end of the tube 9B of the pressure responsive member 9 to stop the flow of water through tub 9B.

Thus, as shown in FIG. 3, one of the features of the present disclosure is that if that the nozzle assembly 3, or riser portion 2 of the sprinkler 1 is damaged, flow is stopped by movement of the rod 6 upward to allow the disc portion 39 to close off the upstream, bottom end of tube 9B. The pressure of the water will hold disc 39 against the circumferential open end of pressure regulating throttle tube 9B until the sprinkler upper end is repaired or a replacement spray nozzle assembly with filter basket is reattached to the top of the riser 2 at 4.

One advantage of combing the flow stop function with the pressure regulating function is economy of fewer parts. In addition, the disclosed combination moves the flow shut off feature down the riser 2 and closer to the sprinkler body that is buried in the ground, so that if the sprinkler riser 2 is cut off by a lawn mower, for example, the flow stop valve will still be in the sprinkler to stop flow.

As shown in FIGS. 2-3, the rod 6 may include a rod extension 21 that allows the shut off feature to be held open without a filter basket 5. This embodiment would be useful where a flush cap 20 (See FIG. 2) is used and no filter is present so that dirt in the line can be cleared through flow out pop-up flap 50 of the flush cap 20 before the flush cap is removed as shown in FIG. 3. It is common to provide a flush cap on a sprinkler body during installation of the system and prior to activation. The flush cap 20, with extension 21, may be used to hold the disc 39 against the seat 7. In a preferred embodiment, the extension rod 21 can be pulled loose at its cup joint 51 from rod 6 when it is desired to install a spray nozzle assembly 3 with filter basket 5, when desired.

Removal of the flush cap 20 and replacing it with a spray nozzle assembly 3 may be done with the water pressure ON. That is, there is no need to turn the system off to install the spray nozzle assembly that typically replaces the flush cap. This is a big advantage, since when the water is turned OFF, the sprinkler riser 2 retracts down into the sprinkler body and is at ground level where dirt and water can flow back into the riser before the new nozzle can be screwed back onto the riser.

In this configuration, the irrigation system water pressure may be left ON to prevent further dirt entering the lines and the riser 2 will remain popped up against its riser retraction spring while the flow of water out of the sprinkler will be shut off. Thereafter, the extension rod 21 may be removed and the desired spray nozzle assembly 3 may be screwed into place. The nozzle assembly 3 will then push the rod 6 down and move the disc 39 out of the open end of the flow tube 9B. This may be accomplished while the user avoids getting wet since the disc 39 is raised up to block the upstream, bottom end of the tube 9B, and thus prevents water flow up and out of the sprinkler 1 and while ensuring no dirt gets back into the sprinkler 1.

The pressure regulating function is not affected as long as the center rod 6 is properly held down in place so that the disc 39 is held at the correct distance, that is a predetermined distance from the throttling end of pressure responsive member 9 tube portion 9B. The tube 9B extends through the reference pressure chamber 101 in the riser tube 2 that houses the pressure responsive member 9 and bias force spring 8. The reference pressure chamber 101 is vented to atmospheric pressure at 60 by a small hole through the wall 14 of the sprinkler riser tube 2.

The lower end of the reference pressure chamber 101 is closed by a donut shaped member 10 with a seal 11 to the inside wall of the riser tube 2. There is also a low friction sliding seal to the pressure responsive member's tube 9B so that it may easily move up and down to adjust the pressure flow throttling opening between the upstream lower circumferential opening of 9B and the disc portion 39 of the push rod. That is, the tube 9*b* of the pressure responsive member 9 is movable relative to the disc 39 based on the pressure differential between a reference pressure in the reference pressure chamber 101 and the pressure of water flowing into the riser 2 from sprinkler base 102. This pressure regulation provides more or less constant pressure to the nozzle assembly 3 to exit the sprinkler 1.

The center push rod 6 is axially centered in the riser tube 2 by ribs 54 on the top of the pressure responsive member 9 and by a hole at 15 in the center of the lower retention and centering cap 7 which is snap fitted at 13 into the lower end of riser tube 2.

Figure 4:
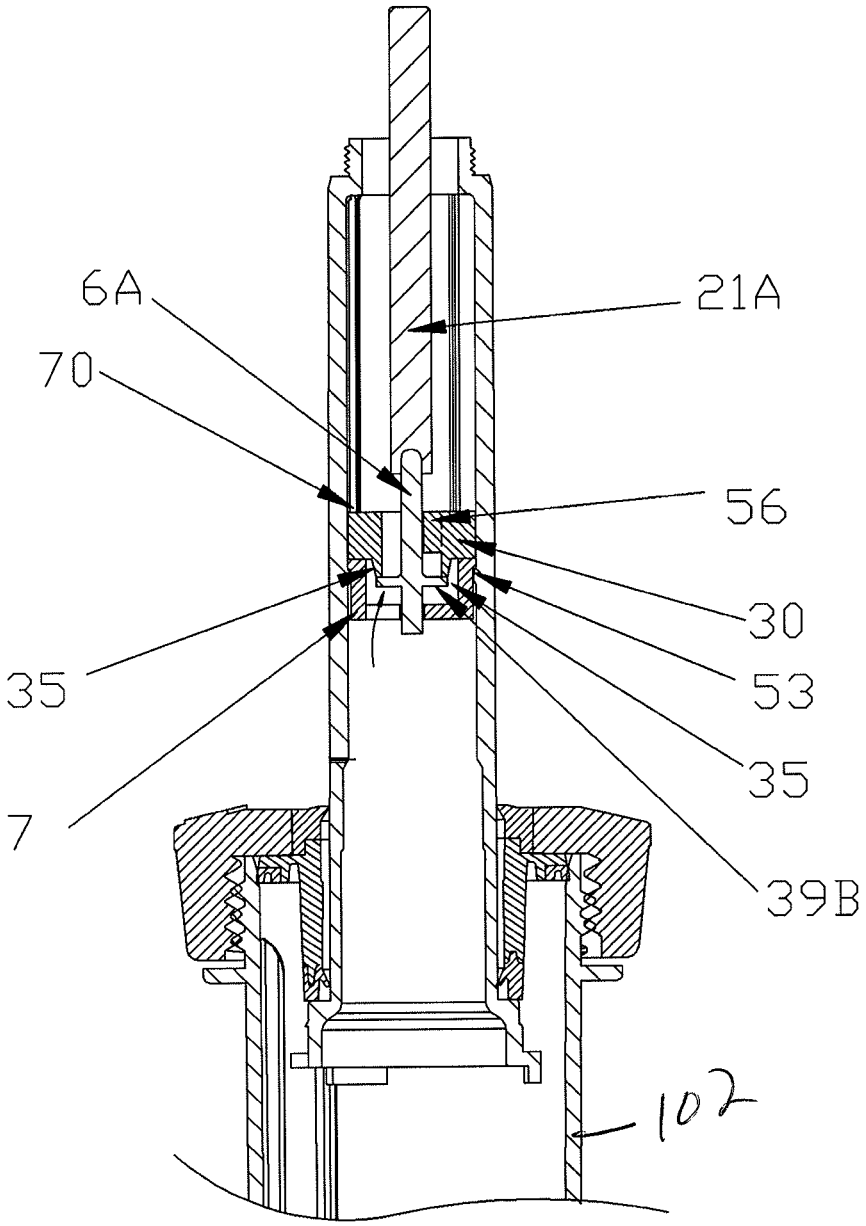
FIG. 4 is similar to FIG. 3, but shown without a pressure regulating valve components and closure member is moved upward in the riser to stop where it is secured in accordance with an embodiment of the present disclosure.

FIG. 4 shows an embodiment that includes the flow stop feature as described, but without the pressure regulating function. This embodiment may be used in irrigation systems that do not experience large line pressure differences, and thus, do not require pressure regulation. By lengthening the push rod, this flow stop valve can be put at the bottom of the riser 2 to protect it against damage to the riser, if desired. As shown in FIG. 4, the flush cap has been removed and the flow valve disc 39B has been pushed up by the flow pressure out of the center opening in flow stop valve seat member 30 against the circumferential edges of the center opening at 35. The system pressure is still on to hold the riser tube 2 up as shown and the flow stop shut off disc in the up and closed position.

In FIG. 4, the push rod extension 21A has not yet been pulled off the top of the push rod 6A. With pressure remaining on, the extension rod 21A may be lifted out and a new desired spray nozzle assembly mounted on the thread at the top of the riser 2 may be provided. As the new nozzle assembly including a filter basket is screwed onto the thread, the filter basket bottom will push the center push rod 6A downwardly pushing disc portion 39B downwardly opening the flow stop valve disc area at 35.

The filter bottom holds the disc 39B down and in an open position by not allowing the on center sprinkler axis push rod 6 of the flow stop valve to move upward by contact with the bottom of the filter basket so long as the spray nozzle assembly is properly in place on the top of the riser assembly for proper sprinkler water distribution.

The regulating assembly 100 therefore includes pressure responsive member 9 with an element, tube 9B that is moved against a bias spring 8 based on pressure in a pressure area 101 as sensed to provide the desired sprinkler operation pressure. The bias spring 8 is housed in a cylindrical reference pressure area 101, which is desirably referenced to atmospheric pressure. The pressure responsive member 9 is coupled to a relatively pressure balanced throttling valve 39 positioned upstream that, in this case, restricts the flow through the sprinkler as it senses operating pressure exceeding a desired operating pressure for the sprinkler in a system. This provides uniform and known performance, that is, matched precipitation for a sprinkler of a particular zone whether it is the first or last sprinkler in the system and regardless of position in the system, i.e. at the top of a hill or at the bottom of the hill.

The regulating member 100 also prevents very high misting and overspray during periods of unusually high supply pressures, which may occur in municipal water supplies in early morning operation, for example.

In the present disclosure, the upstream pressure regulating valve area includes a valve element 39 that is held in place by the presence of the sprinkler's spray nozzle 3 and the integrity of the sprinkler's assembly. If the sprinkler nozzle assembly 3 is cut off or knocked off, or its riser 2 is cut, as often happens by landscape service, then this movable valve seat 39 is allowed to move to a closed position against the pressure regulating tube 9B.

Another desirable feature of the present disclosure is that when a sprinkler nozzle is being installed or changed, the flow out of the sprinkler is shut off since the nozzle assembly is not present to hold the flow shut off valve component open.

A sprinkler 1, that includes both a flow shut off and pressure regulator is particularly useful for municipalities along roadways and in parks, as well as for homeowners who seldom walk their entire yard when the sprinklers are running.

Although the present invention has been described in relation to particular embodiments thereof, many other variations and modifications and other uses will become apparent to those skilled in the art.

What is claimed is:

1. A sprinkler comprising:

a sprinkler body in fluid communication with a water supply to provide water to the sprinkler;

a riser movably mounted in the sprinkler body and in fluid communication with the sprinkler body such that the riser rises up and out of the sprinkler body when water is provided to the sprinkler, the riser further comprising:

a biasing member; and a reference pressure chamber configured to provide a predefined reference pressure;

a nozzle assembly mounted on a top end of the riser and in fluid communication with the riser; and a pressure regulating assembly mounted in the riser with a member in contact with a portion of the nozzle assembly, wherein the nozzle assembly holds the pressure regulating assembly in an open position to allow flow of water to the nozzle assembly, the pressure regulating assembly also configured to maintain a substantially constant water pressure in the nozzle assembly, the pressure regulating assembly further comprising a hollow tube extending through the reference pressure chamber and including a first end in fluid communication with the sprinkler body and a second end in fluid communication with the nozzle assembly, the hollow tube movable relative to the reference pressure chamber;

wherein the riser further comprises a valve seat positioned below the hollow tube.

2. The sprinkler of claim 1, wherein the biasing element is housed in the reference pressure chamber and in contact with a pressure responsive member which is attached to the hollow tube to provide a biasing force to maintain the first end of the hollow tube a predetermined distance from the valve seat when a pressure differential between the reference pressure chamber and an area of the valve seat is below a threshold value.

3. The sprinkler 2, wherein the hollow tube moves relative to the valve seat when the pressure differential between the reference pressure chamber and the pressure in an area above a top of the pressure responsive member at a nozzle entrance exceeds the threshold value to provide the substantially constant water pressure in the nozzle assembly.

4. The sprinkler of claim 2, wherein the pressure regulating assembly further comprises a disc shaped valve member configured to be mounted in the valve seat to allow flow of water from the sprinkler body, through the hollow tube and to the nozzle assembly when the nozzle assembly is in place on the riser.

5. The sprinkler of claim 4, further comprising a post extending upward from the disc shaped valve member, through the hollow tube and contacting the portion of the nozzle assembly to hold the disc shaped valve member in place in the valve seat.

6. The sprinkler of claim 5, wherein the disc shaped valve member is movable upward toward the first end of the tube when the post is not in contact with the portion of the nozzle assembly to prevent the flow of water into the hollow tube.

7. The sprinkler of claim 1, wherein the pressure regulating assembly further comprises a hollow tube element with a first end in fluid communication with the sprinkler body and a second end in fluid communication with the nozzle assembly.

8. The sprinkler of claim 7, wherein the riser further comprises a valve seat positioned a predetermined distance below the first end of the hollow tube.

9. The sprinkler of claim 8, wherein the pressure regulating assembly further comprises a disc shaped valve member configured to be mounted in the valve seat to allow flow of water from the sprinkler body through the hollow tube and to the sprinkler assembly.

10. The sprinkler of claim 9, further comprising a post extending upward from the disc shaped valve member, through the hollow tube and contacting the portion of the nozzle assembly to hold the disc shaped valve member in place in the valve seat.

11. The sprinkler of claim 10, wherein the disc shaped valve member is movable upward toward the first end of the tube when the post is not in contact with the portion of the nozzle assembly to prevent the flow of water into the hollow tube.

* * * * *